US012618649B2

(12) United States Patent
Bucks et al.

(10) Patent No.: US 12,618,649 B2
(45) Date of Patent: May 5, 2026

(54) ARMOR SYSTEM

(71) Applicant: American Defense Structures, LLC, Scottsdale, AZ (US)

(72) Inventors: Grant Bucks, Scottsdale, AZ (US); Jeffrey Clement, Scottsdale, AZ (US); John Damyanovich, Scottsdale, AZ (US); David Fair, Scottsdale, AZ (US); Garrett Garner, Scottsdale, AZ (US)

(73) Assignee: American Defense Structures, LLC, Scottsdale, AZ (US)

( * ) Notice: Subject to any disclaimer, the term of this patent is extended or adjusted under 35 U.S.C. 154(b) by 46 days.

(21) Appl. No.: 18/676,390

(22) Filed: May 28, 2024

(65) Prior Publication Data

US 2024/0401914 A1 Dec. 5, 2024

Related U.S. Application Data

(60) Provisional application No. 63/605,271, filed on Dec. 1, 2023, provisional application No. 63/579,261, filed on Aug. 28, 2023, provisional application No. 63/504,686, filed on May 26, 2023.

(51) Int. Cl.
*F41H 5/08* (2006.01)
*F41H 5/04* (2006.01)

(52) U.S. Cl.
CPC ..... *F41H 5/08* (2013.01); *F41H 5/0478* (2013.01)

(58) Field of Classification Search
CPC ..... F41H 5/08; F41H 5/0478
USPC ..... 89/36.07
See application file for complete search history.

(56) References Cited

U.S. PATENT DOCUMENTS

| | | | | |
|---|---|---|---|---|
| 11,653,744 | B1 * | 5/2023 | Whitfield | A45F 4/02 2/2.5 |
| 11,953,293 | B1 * | 4/2024 | Glenn | F41H 1/02 |
| 2006/0243126 | A1 * | 11/2006 | Tyler | F41H 7/00 89/36.01 |
| 2014/0084646 | A1 * | 3/2014 | Benden | F41H 5/08 297/217.1 |
| 2020/0263959 | A1 * | 8/2020 | Dieffenbach | A45F 3/04 |
| 2024/0401914 | A1 * | 12/2024 | Bucks | F41H 5/0478 |

FOREIGN PATENT DOCUMENTS

| | | | | |
|---|---|---|---|---|
| EP | 2037207 | A2 * | 3/2009 | F41H 3/02 |

* cited by examiner

*Primary Examiner* — Samir Abdosh
(74) *Attorney, Agent, or Firm* — KW Law, LLP

(57) ABSTRACT

The ballistic system described in the present disclosure may be used in vehicle settings and by a user as a shield. The ballistic system may comprise a cover, a headrest hood, and an armor system. The ballistic system may include one or more attachment devices or straps. The ballistic system may include a handle and an accessory panel. A portion of the ballistic system may be installed in the seat back pocket of a car. The ballistic systems described herein may be deployed by a user.

13 Claims, 15 Drawing Sheets

ARMOR SYSTEM

CROSS REFERENCE TO RELATED APPLICATIONS

The present application claims priority to and the benefit of U.S. Provisional Application No. 63/504,686 filed on May 26, 2023, and U.S. Provisional Application No. 63/579,261 filed on Aug. 28, 2023, and U.S. Provisional Application No. 63/605,271 filed on Dec. 1, 2023, each of which is incorporated by reference in its entirety for any purpose.

FIELD

The present disclosure relates to ballistic systems. More specifically, the present disclosure relates to ballistic systems for vehicles.

BACKGROUND

The present disclosure pertains to an innovative ballistic armor panel designed to enhance personal protection against ballistic threats. Ballistic armor panels play a crucial role in safeguarding individuals from the impact of projectiles by absorbing and dissipating kinetic energy. The disclosure focuses on optimizing the composition, structure, and materials of the armor panel to achieve superior ballistic resistance while ensuring flexibility and reduced weight. The panel's advanced design not only enhances protective capabilities but also facilitates practical deployment in real world scenarios.

SUMMARY

In various embodiments, a ballistic system may comprise a cover, a headrest hood, an armor assembly and a backer. The cover may define an opening and form a pocket. The headrest hood may be operatively coupled to the cover. The headrest hood may be configured to be installed over a headrest of a vehicle. The armor assembly may be installable in the cover. The backer may be partially installable in the cover. The backer may include a protruding portion that extends out of the cover.

In various embodiments, the cover may be made of 1000 denier nylon. The cover may comprise a front and a back. The cover may include a mole array of the front of the cover. The back may contact a back of the vehicle seat in response to the ballistic seat backer being installed in the vehicle. The cover may be sized such that it provides ballistic coverage for the headrest of the vehicle. The cover may have a top curved portion In various embodiments, the headrest hood may be made of a 4 way stretch nylon material. The backer may be a rigid backer or a semi rigid backer (e.g., plastic). The protruding portion of the backer may be sized to install in a rear pocket of a vehicle seat.

In various embodiments, the ballistic system may further comprise a handle. The handle may be operatively coupled to the backer.

In various embodiments, the armor system may include a plurality of unidirectional aramid or polyethylene ballistic laminate sheets. The armor system may also include one or more woven aramid fabric sheets.

In various embodiments, the cover and the armor system may have nesting perimeter profiles. In this regard, the armor system may have the same general perimeter shape as the cover but may be slightly smaller so that the armor system can be installed within the pocket defined by the cover. Similarly, the cover and the backer have nesting perimeter profiles. In this regard, the backer may have the same general perimeter shape as the cover but may be slightly smaller so that the backer can be installed within the pocket defined by the cover.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the inventions, it should be understood that other embodiments may be realized and that logical, chemical, and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full and/or any other possible attachment option. Additionally, any reference to without contact (or similar phrases) may also include reduced contact or minimal contact.

In various embodiments, the various ballistic systems are configured to provide ballistic protection for vehicle passengers. Traditional vehicle armor systems are heavy and expensive. They often require significant time to build and may require that the vehicles drive train and suspension be modified or replaced to manage the weight of the system. Moreover, if the vehicle is damaged and has to be replaced, the armor system is typically not reusable.

Figure 1:
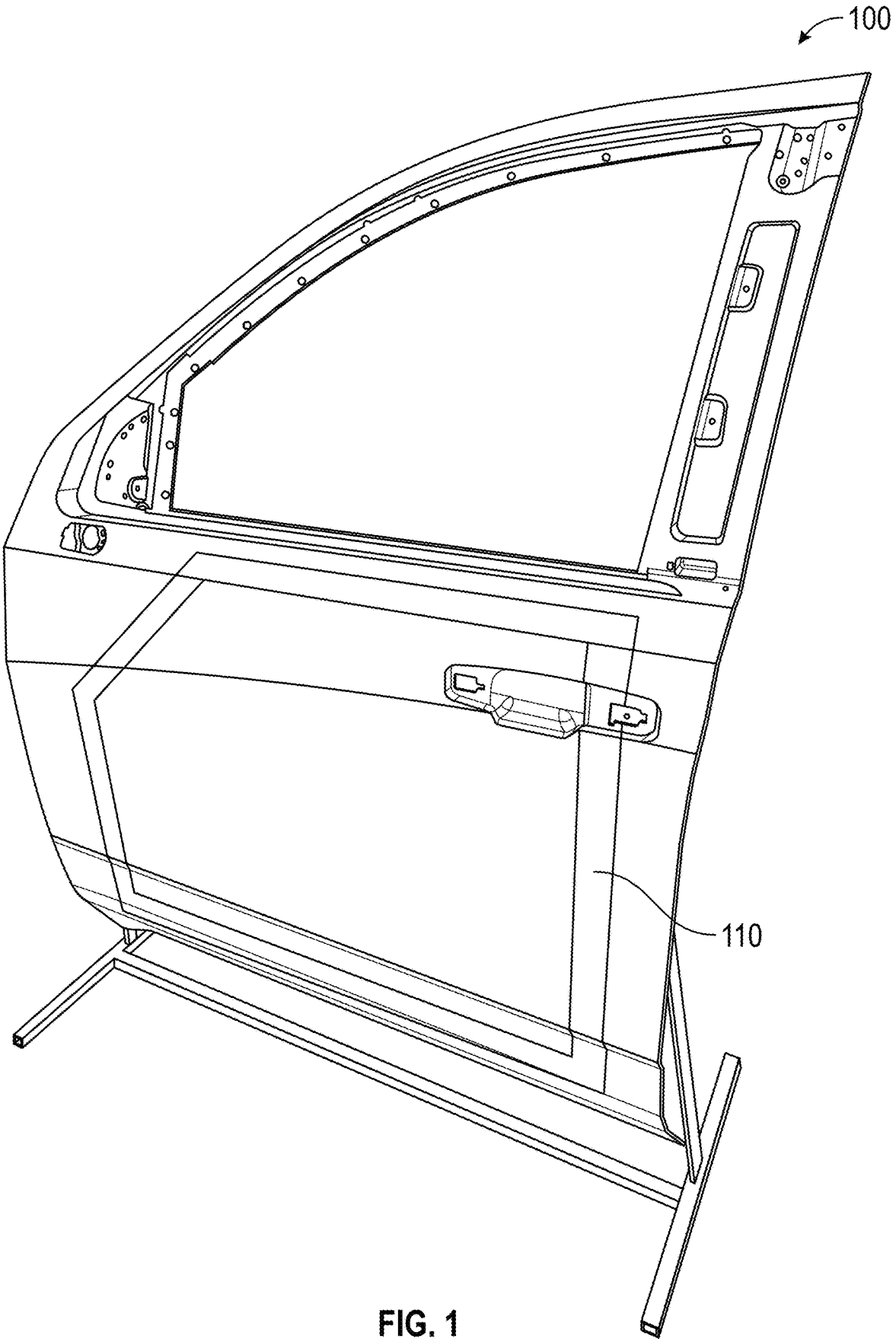
FIG. 1 illustrates a first view of a vehicle door defining a ballistic region, in accordance with various embodiments.
Figure 2:
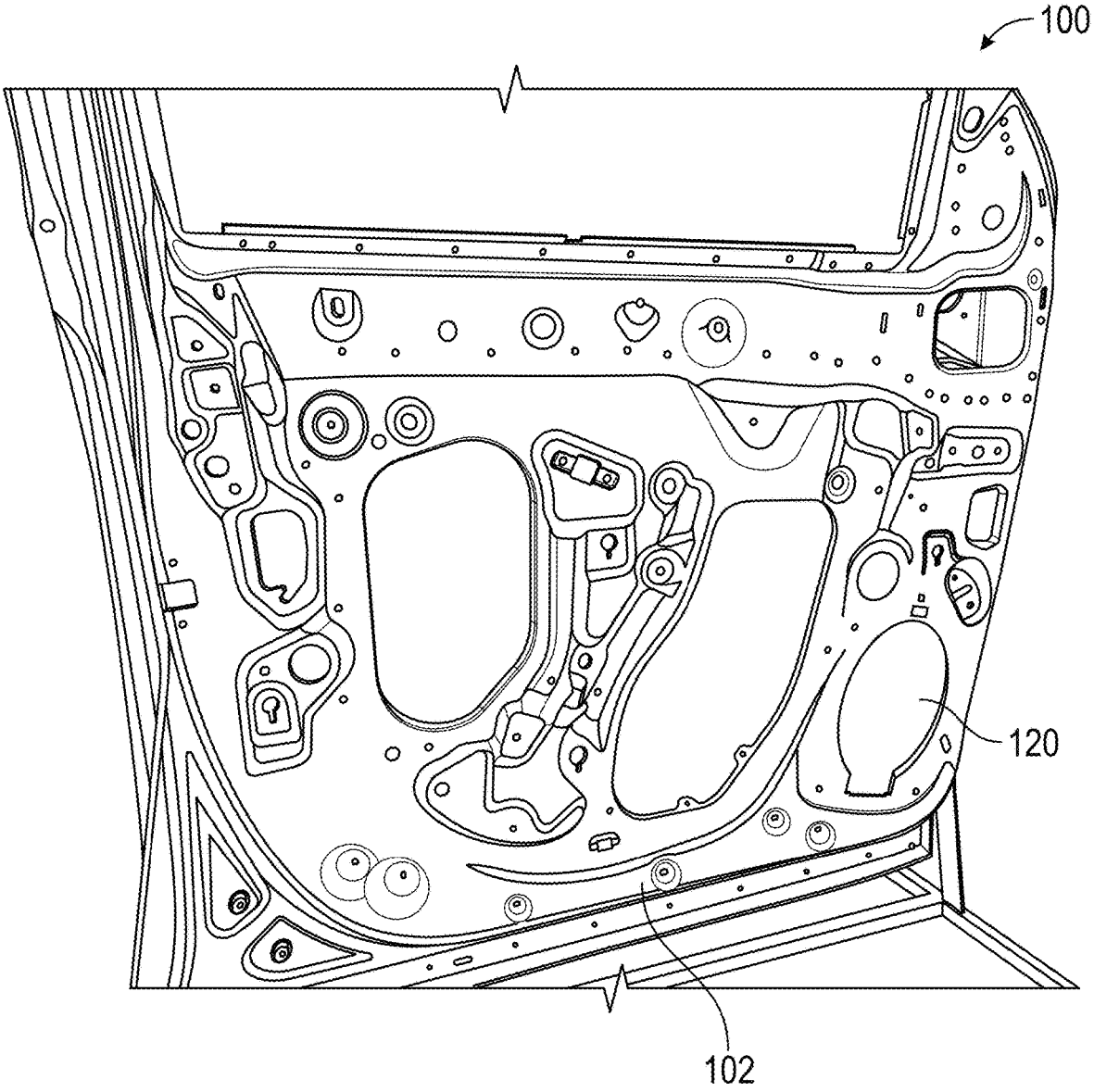
FIG. 2 illustrates a second view of a vehicle door including ballistic material, in accordance with various embodiments.
Figure 3:
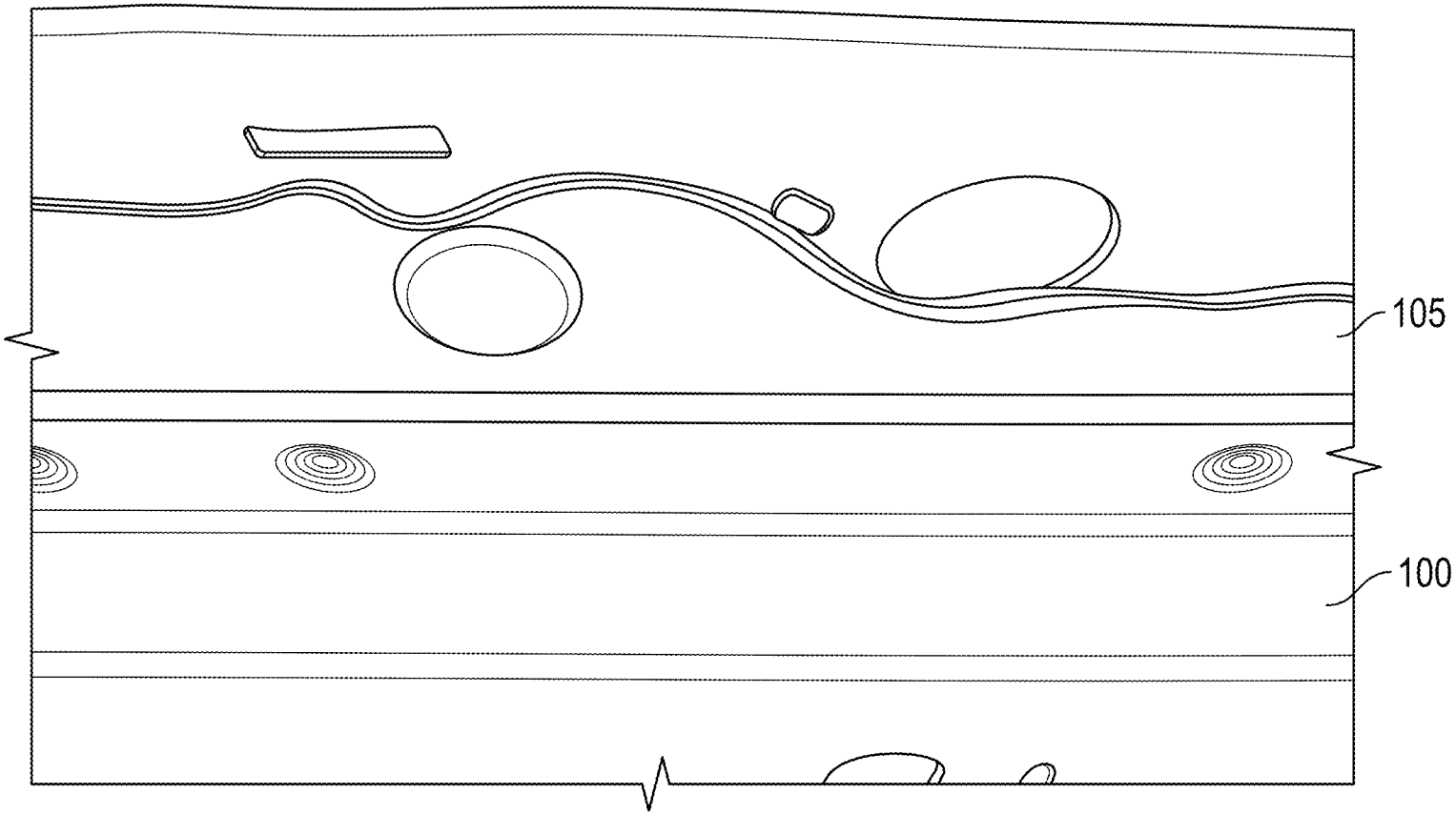
FIG. 3 illustrates a view of a vehicle door interior volume, in accordance with various embodiments.

In various embodiments and with reference to FIG. 1, FIG. 2 and FIG. 3, a vehicle door 100 may be configured with a ballistic system in an identified ballistic zone 110. Ballistic zone 110 may be an area associated with an area occupied by a vehicle passenger. Ballistic zone 110 may also be associated with a hollow area of a vehicle door that is sized to receive ballistic material 120.

Ballistic material 120 may be any suitable ballistic material and may be a soft armor system, a semi rigid system, or a hard armor system. Ballistic material 120 may be configured for specific threats. In this regard, a low-cost ballistic system may be configured with ballistic material 120 that is configured to stop lower threat projectiles (e.g., 9 mm ammunition) that is commonly encountered by police officers.

In various embodiments, ballistic material 120 may be installed in a hollow volume 102 of vehicle door 100. Ballistic material 120 may be installed adjacent to the window of vehicle door 100. To install ballistic material 120, the window of vehicle door 100 may be removed. Ballistic material 120 may be installed in the adjacent the plane that the window travels along in vehicle door 100.

Ballistic material 120 may be adhered to a portion of vehicle door 100 associated with hollow volume 102. Ballistic material 120 may be adhered to vehicle door 100 with any suitable fastener, tape, glue or other bonding agent that does not damage ballistic material 120. Ballistic material 120 may also be tucked into hollow volume 102 depending on the size and shape of ballistic material 120 and hollow volume 102.

Figure 4:
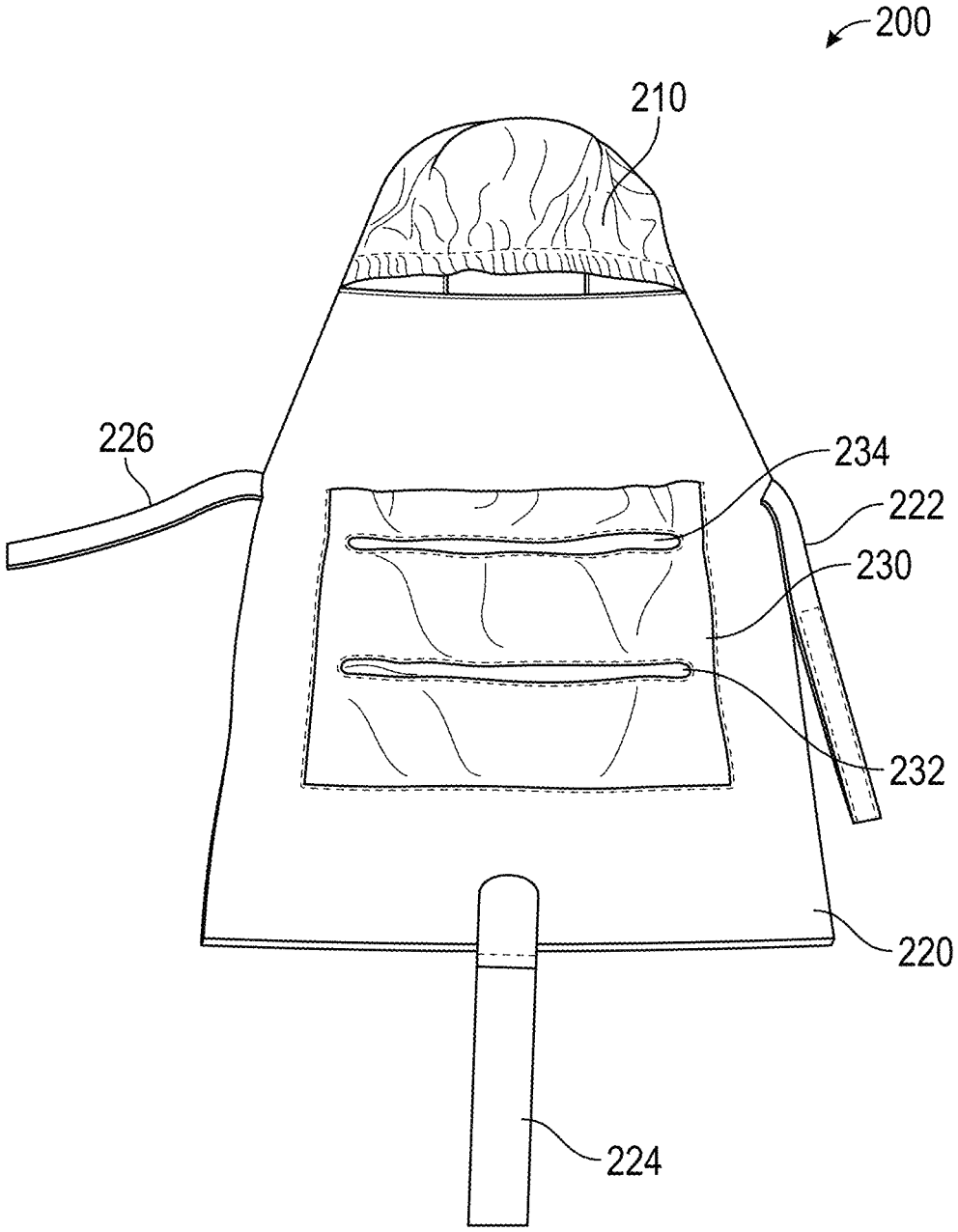
FIG. 4 is a first view of a ballistic seat panel, in accordance with various embodiments.
Figure 5:
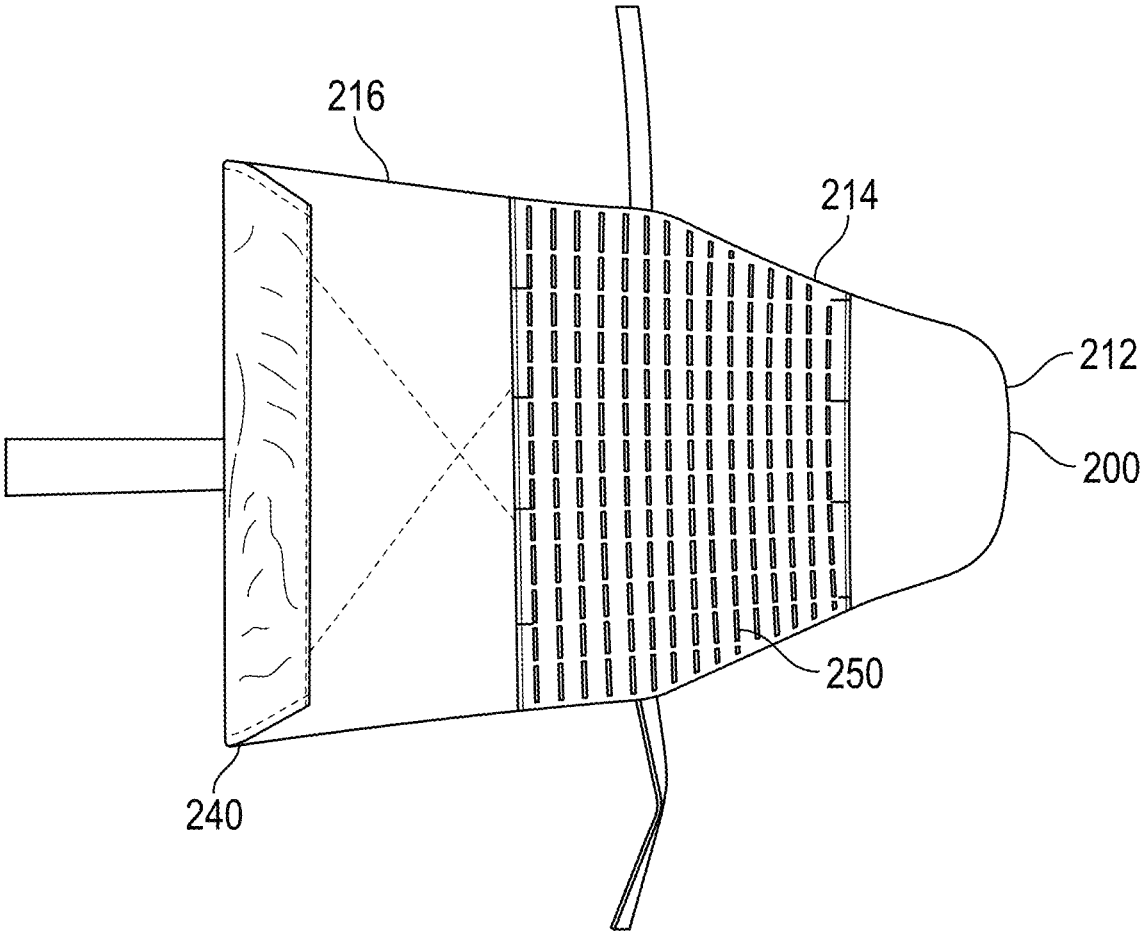
FIG. 5 is a second view of a ballistic seat panel, in accordance with various embodiments.
Figure 7:
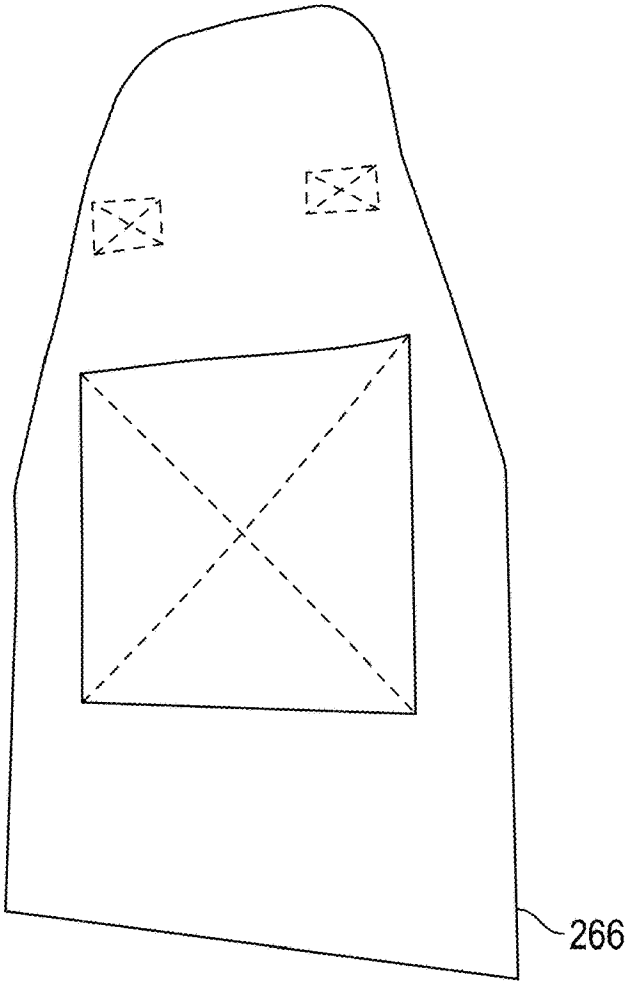
FIG. 7 is a second view of a ballistic insert, in accordance with various embodiments.
Figure 6:
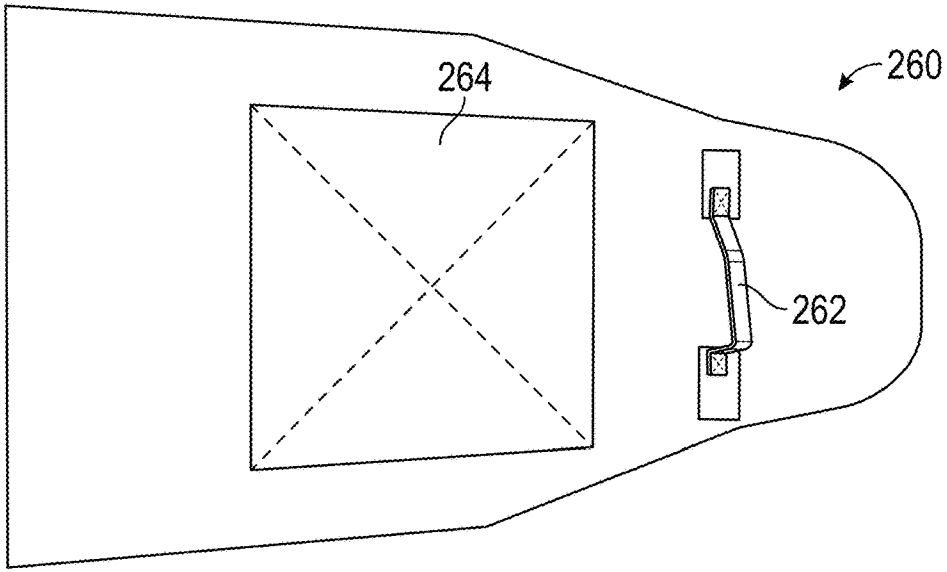
FIG. 6 is a first view of a ballistic insert, in accordance with various embodiments.
Figure 8:
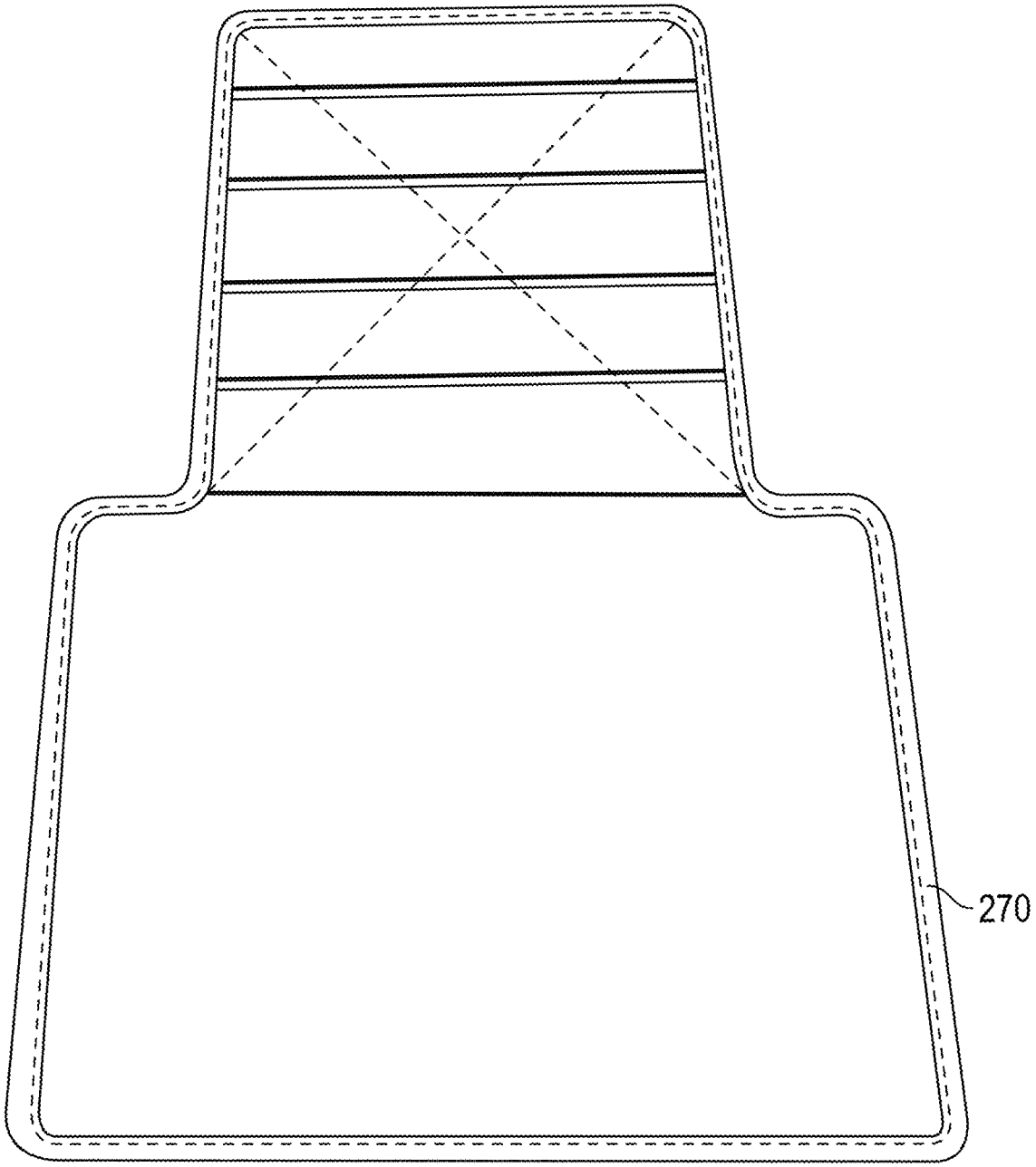
FIG. 8 is a ballistic seat panel guide, in accordance with various embodiments.
Figure 9:
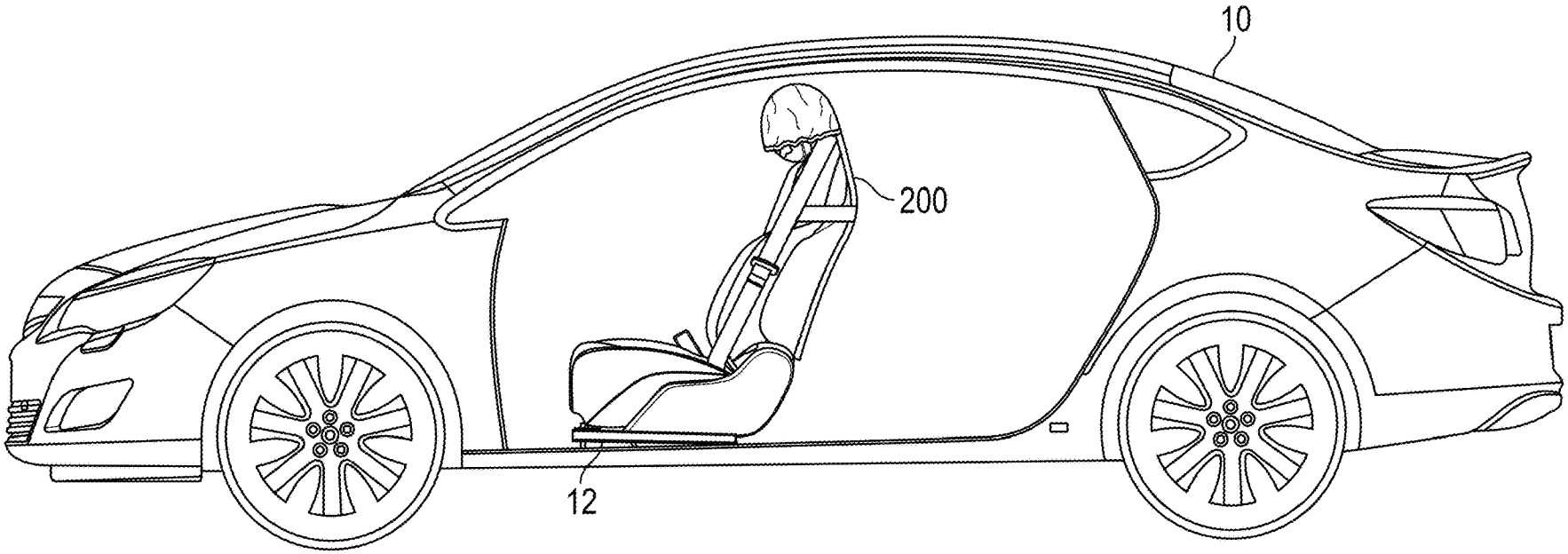
FIG. 9 is a cross-sectional view an armor system deployed inside a vehicle, in accordance with various embodiments.
Figure 10:
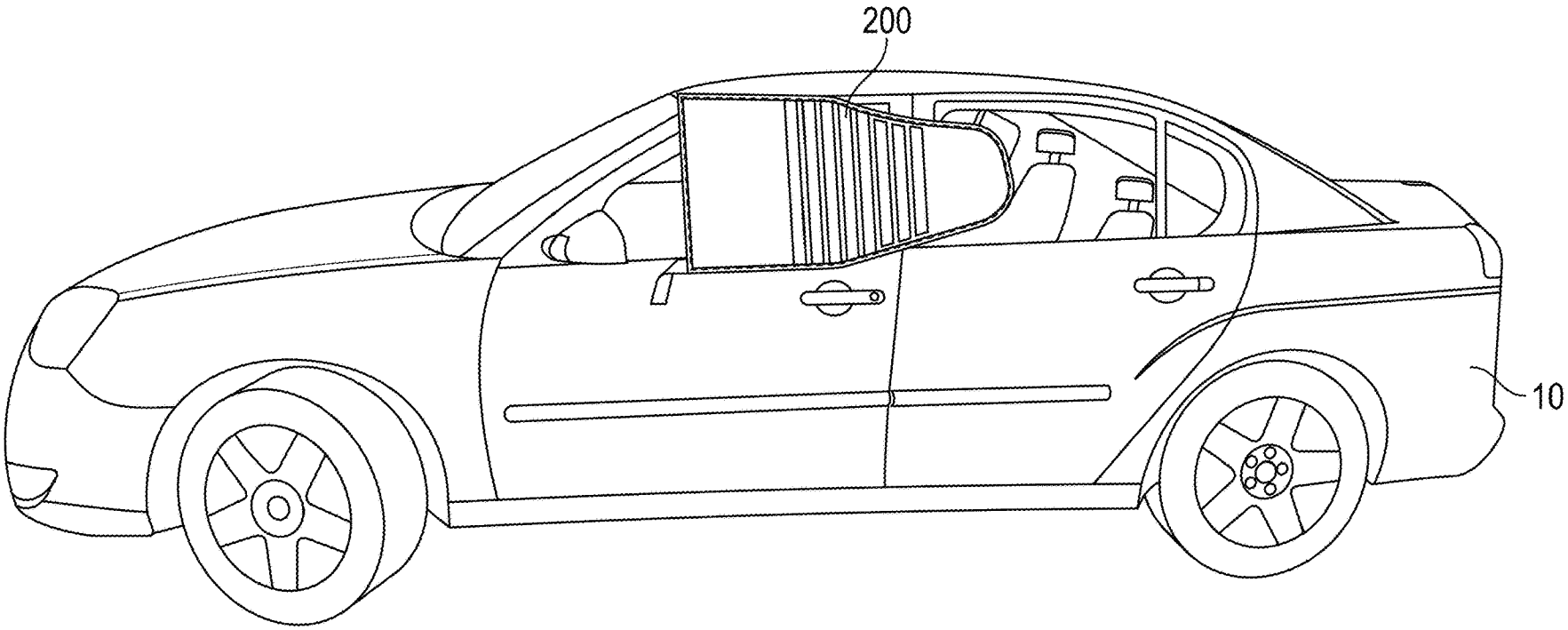
FIG. 10 is a first view of an armor system deployed on a vehicle, in accordance with various embodiments.
Figure 11:
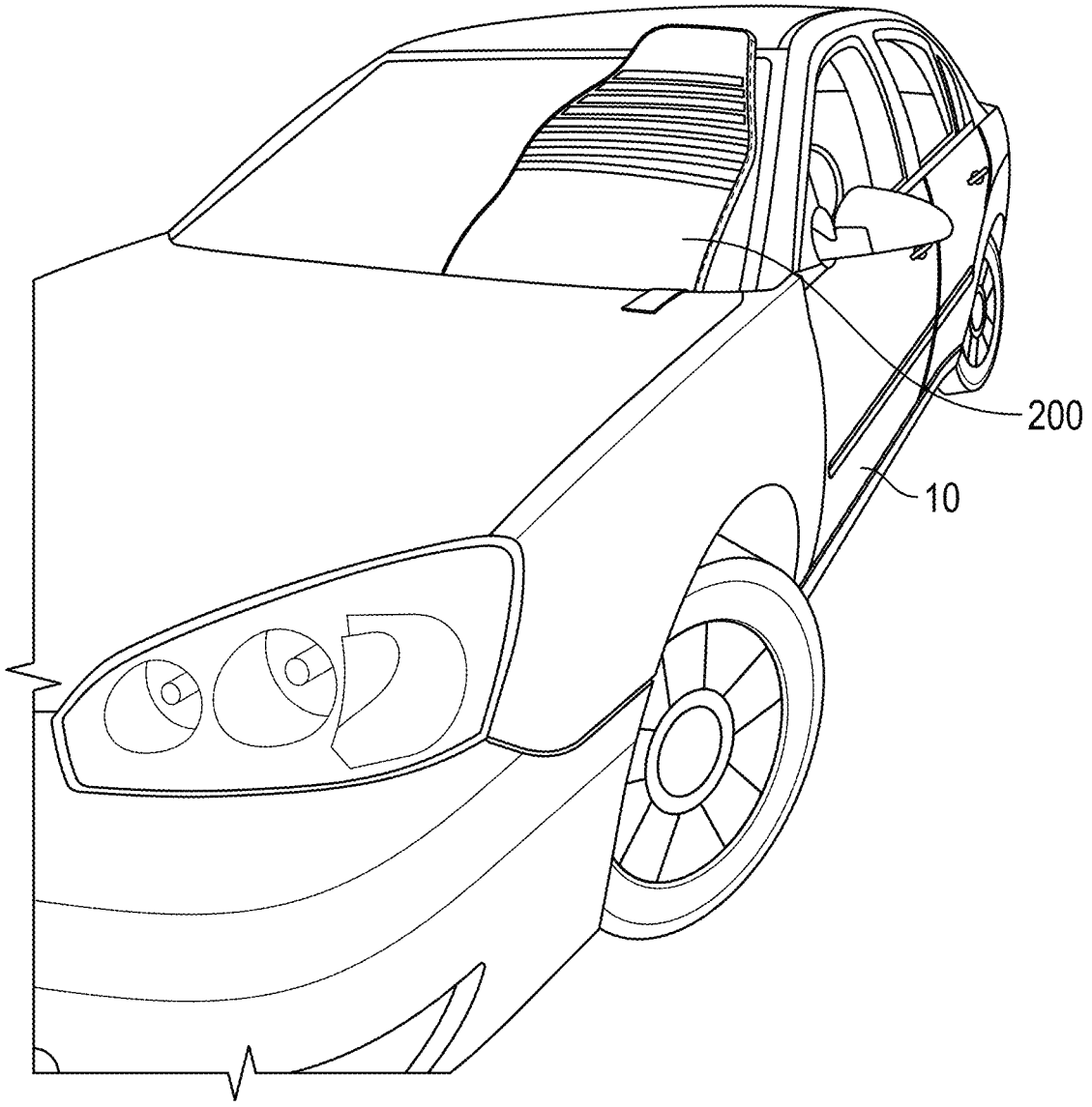
FIG. 11 is a second view of an armor system deployed on a vehicle, in accordance with various embodiments.
Figure 12:
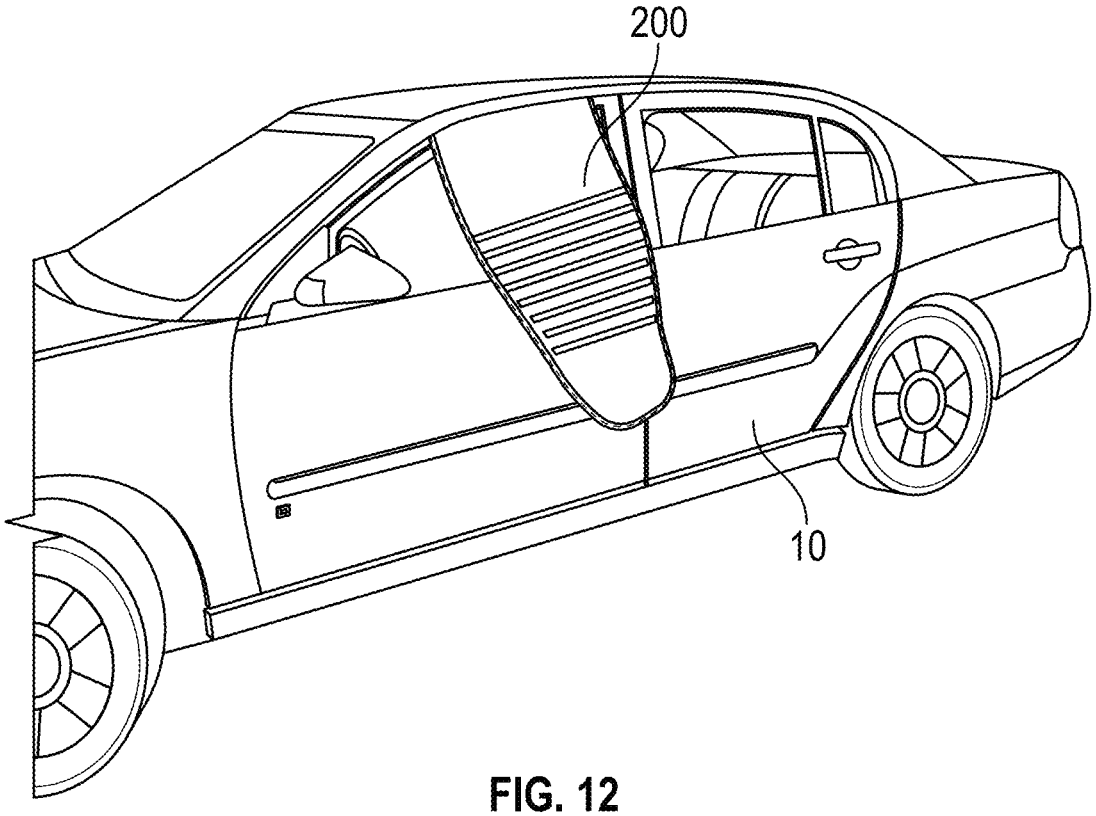
FIG. 12 is a third view of an armor system deployed on a vehicle, in accordance with various embodiments.
Figure 13:
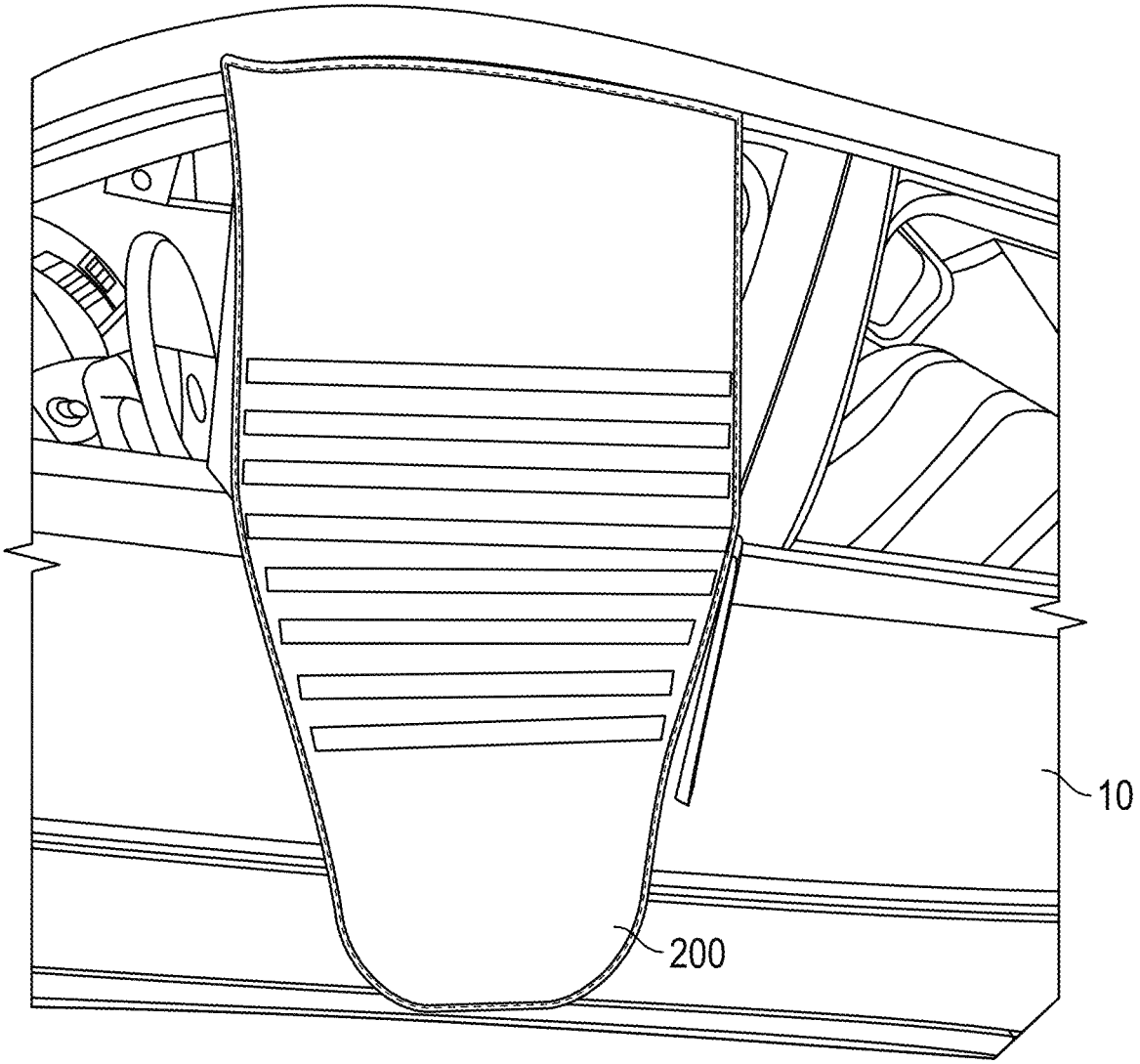
FIG. 13 is a detailed view of an armor system deployed on a vehicle, in accordance with various embodiments.

In various embodiments and with reference to FIG. 4 and FIG. 5, a ballistic system 200 may comprise a cover 220, a headrest hood 210. Cover 220 may define an opening forming a pocket that is closed by flap 240. Cover 220 may be made of any suitable material. For example, cover 220 may be made of 1000 denier nylon. Cover 220 may comprise a front and a back. The back of cover 220 may contact a back of a vehicle seat in response to the ballistic system 200 being installed in a vehicle. Cover 220 may include a MOLLE array 250 of the front of cover 220. MOLLE array 250 may be used to attached various accessories.

In various embodiments, cover 220 may comprise one or more straps to attached cover 220 to a vehicle seat. For example, cover 220 may comprise a first side strap 222. First side strap 222 may comprise hook and loop fasteners or a buckle system. In this regard, first side strap 222 may be attachable to itself, to cover 220, or to another strap. Cover 220 may comprise a second side strap 226. Second side strap 226 may comprise hook and loop fasteners or a buckle system. In this regard, second side strap 226 may be attachable to itself, to cover 220, or to another strap. Cover 220 may comprise a bottom strap 224. Bottom strap 226 may comprise hook and loop fasteners or a buckle system. In this regard, bottom strap 226 may be attachable to itself, to cover 220, or to another strap.

In various embodiments, headrest hood 210 may be operatively coupled to cover 220. Headrest hood 210 may configured to be installed over a headrest of a vehicle. Headrest hood 210 may be made of a suitably flexible material that elastically deforms. For example, headrest hood 210 may be made of a 4 way stretch nylon material.

In various embodiments, headrest hood 210 and/or cover 220 may have a curved top profile 212. Curved provide 212 may be operatively coupled to a tapered portion 214. Tapered portion 214 may be operatively coupled to a substantially rectangular portion 216.

In various embodiments, cover 220 may be sized to substantially cover the rear surface of a vehicle seat. Cover 220 may also be shaped such that it provides ballistic coverage for the vehicle headrest. In this regard, ballistic system 200 may provide ballistic coverage for a seated vehicle passenger.

In various embodiments and with reference to FIG. 4, FIG. 6, FIG. 7 and FIG. 8, ballistic system 200 may comprise a backer 260. Baker 260 may be partially installable in cover 220. Backer 260 may have a corresponding profile to cover 220. Backer 260, and more specifically, a bottom portion 266 of backer 260, may protrude through panel 230 of cover 220. More specifically, backer 260 may protrude through slot 232 or slot 234 of panel 230 in cover 220. Bottom portion 266 may be installable in a vehicle seat pocket to allow ballistic system 200 to be secured to a vehicle seat. Backer 260 may be configured with a carry device or handle 262. Handle 262 may be sewn to backer 260. Handle 262 may be accessible through cover 220. Backer 260 may be a semi rigid. For example, backer 260 may be made of a plastic or composite material. Backer 260 may include a partial cover to prevent damage to the vehicle seat.

In various embodiments, ballistic system 200 may further comprise an armor assembly 270. Armor assembly 270 may be installable in cover 220. Armor assembly 270 may be sewn to and/or operatively coupled to backer 260. Armor assembly 270 may be shaped and sized with a profile that is substantially similar to cover 220 or backer 260. More details about the construction of armor assembly 270 may be found herein.

In various embodiments and with reference to FIG. 9-FIG. 13, ballistic system 200 may be deployed inside or outside of a vehicle 10. For example, ballistic system 200 may be deployed on one or more passenger seats 12 of vehicle 10. In another example, ballistic system 200 may be positioned over an opening in vehicle 10 (e.g., a window opening). In another example, ballistic system 200 may be positioned over a vehicle window, the front windshield or the rear windshield. Ballistic system 200 may also be carried by a user as a shield.

Figure 15:
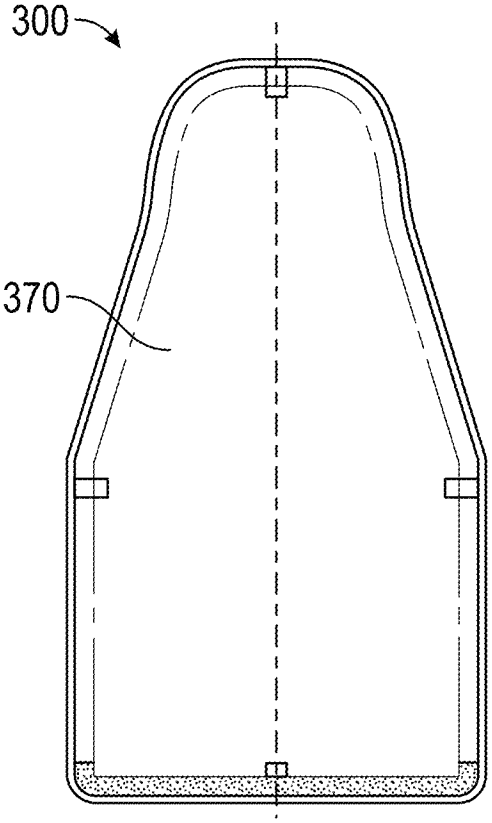
FIG. 15 is a front view of a ballistic system, in accordance with various embodiments.
Figure 14:
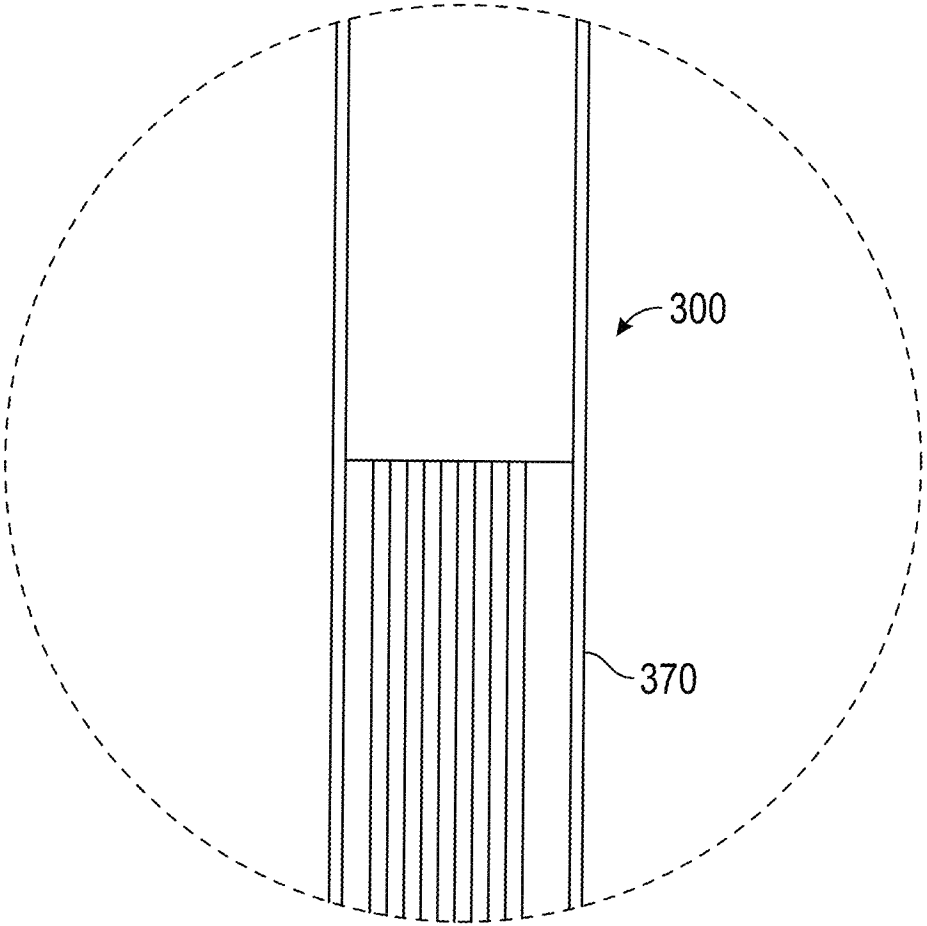
FIG. 14 is an example ballistic layup, in accordance with various embodiments.
Figure 16:
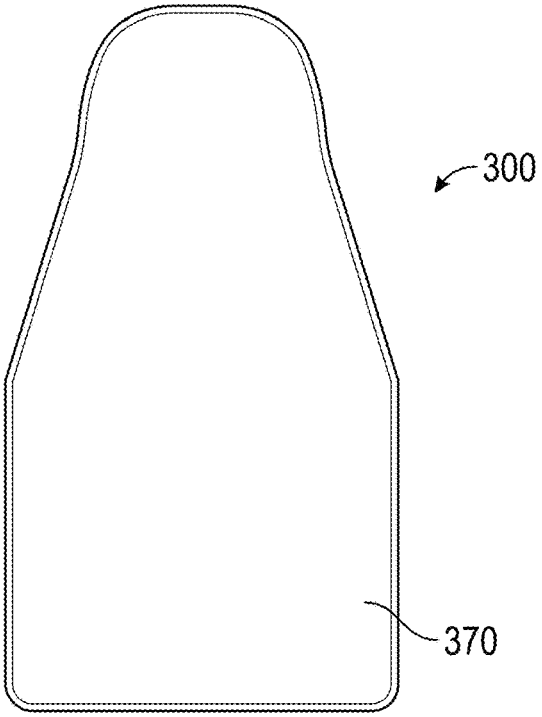
FIG. 16 is a back view of a ballistic system, in accordance with various embodiments.

In various embodiments and with reference to FIGS. 14-16, ballistic system 300 may comprise an armor system 370 that is a semi-rigid semi-flexible system. Armor system 370 and/or ballistic system 300 may be is suitable for deployment as a panel in a vehicle or as a stand-alone shield. Armor system 370 may be light weight so that it may be deployable from the interior of a vehicle. As discussed herein, armor system 370 may also be positionable on the back side of a vehicle seat to provide protection for a person seated in a vehicle. Armor system 370 and/or ballistic system 300 may also be deployed over a vehicle opening or window.

Figure 17:
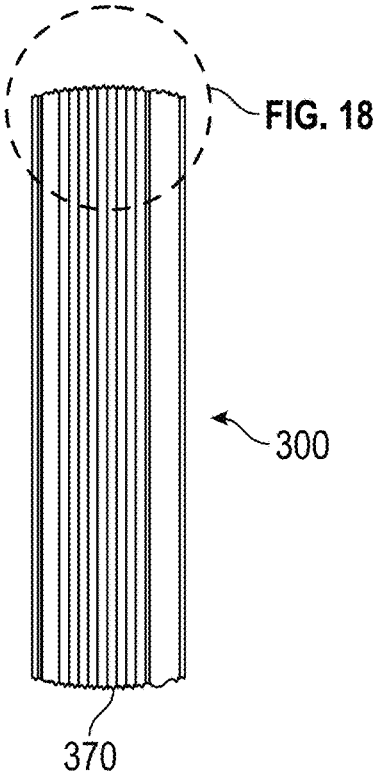
FIG. 17 is a cross-section of a ballistic system, in accordance with various embodiments.
Figure 18:
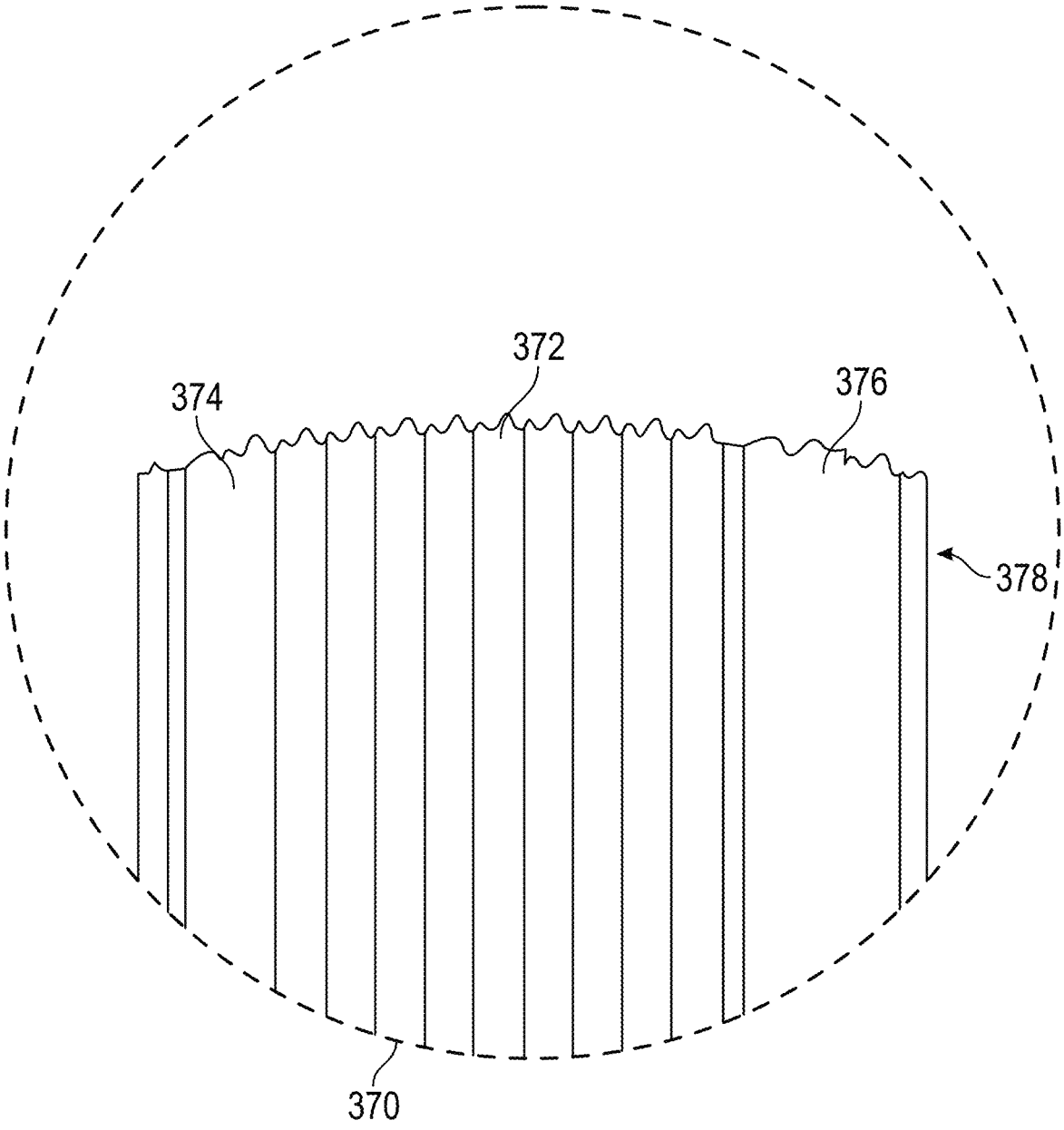
FIG. 18 is a detailed cross-section of a portion of a ballistic system, in accordance with various embodiments.

In various embodiments and with reference to FIGS. 17-18, ballistic system may comprise a ballistic package comprised of one or more aramid or polyethylene ballistic sheets. The ballistic system may include a plurality of unidirectional aramid or polyethylene ballistic laminate sheets 372. For example, the ballistic system may include 9 unidirectional aramid or polyethylene ballistic laminate sheets 372. In another example, the ballistic system may include between 5 and 10 unidirectional aramid or polyethylene ballistic laminate sheets 372. The ballistic system may also include one or more sheets of a woven aramid fabric 374. For example, the ballistic system may include between 1 and 4 sheets of 3000 denier woven aramid fabric 374. In another example, the ballistic system may include 2 sheets of 3000 denier woven aramid fabric 374. The ballistic system may also include a thermoplastic backer 378.

In various embodiments, the ballistic system may be tapped, placed and/or stacked together in an assembly with the various layers of woven aramid fabric 374 positioned at the front of the assembly (e.g., toward the strike face) of armor system 370. The unidirectional aramid ballistic laminate sheets 374 may be positioned behind and/or adjacent to the woven aramid fabric 374. Thermoplastic 374 backer may be positioned adjacent to and behind the unidirectional aramid ballistic laminate sheets 372. The assembly may also be edge sown. The assembly may also be placed and/or sealed in a urethane coated nylon cover 378 to create armor system 370.

Any one of the stitch consolidated assemblies of plies for soft body armor assembly described herein is achieved using any stitching thread and any type of stitching method to achieve through-thickness connectivity of the plies, including chain stitching or lock stitching to secure all plies in the assembly together.

To achieve a desired level of protection, soft body armor assemblies described herein are configured to inhibit the complete penetration of a particular ballistic threat by overcoming the energy associated with the ballistic event. Two examples of commercially available high strength fibers routinely used to generate anti-ballistic ply structures used in soft body armor assembly include para-aramid fiber, such as Kevlar® fiber from Dupont and Twaron® fiber from Teijin, and UHMWPE, including Spectra® fiber from Honeywell and Dyneema® fiber from DSM.

The performance of ballistic protective equipment utilizing ply structures generated from high strength fiber is generally measured based on penetration resistance, as well as the resistance to back face deformation that can lead to blunt trauma injuries. Penetration resistance is routinely reported as the VSO, which is defined as the velocity at which a specific ballistic threat will penetrate an armor construction 50% of the time. A methodology routinely used for determining the VSO of a particular armor system against a specific threat is outlined in Mil-STD 662F VSO Ballistic test for Armor and Purchase Description FQ/PD 07-0SG, Body Armor, Multiple Threat/Interceptor Improved Outer Tactical Vest (IOTV) Generation Ill. The methodology for determining back face deformation is outlined in NIJ Standard 0101.06, Ballistic Resistance of Body Armor. As will be understood from the comparative and experimental examples provided herein, the soft body armor assembly for soft body armor assembly 110 meets these standards and provides numerous advantages over monolithic and other hybrid designs. For example, soft body armor assembly 110 is comfortable, durable, flexible, lightweight, and provides increased performance, including resistance to ballistic penetration, back face deformation performance, resistance to mechanical fatigue, and resistance to fragmentation threat, and the like.

Woven fabrics generated using para-aramid fiber have long demonstrated robust ballistic performance as anti-ballistic ply structures used in flexible armor systems. Woven anti-ballistic fabrics rely on mechanical interlacing of yarns using commercial weaving equipment and are a desired when designing systems that provide flexibility, comfort, conformability, and improved breathability. Additionally, the mechanically interlocked woven fabrics are very durable, requiring no adhesives or matrix resins to create the ballistic ply structure. Woven anti-ballistic fabrics and can undergo significant flexural fatigue without losing ballistic performance. Several investigations of flexible body armor fabricated using woven para-aramid fabrics reclaimed after more than a decade of continuous use in the field have demonstrated no ballistic performance loss when compared to the performance of the same designs when first issued.

Unidirectional laminates represent a second type of anti-ballistic ply structure used in the manufacture of flexible body armor systems. Unidirectional laminates are constructed from two or more layers of unidirectionally oriented high strength yarns adhesively bound together using matrix resins and optionally polymer films. The unidirectional fiber layers in the unidirectional laminate are cross plied; having fiber direction of individual layers rotated 90 degrees relative to the neighboring layers they are laminated to. Unidirectional laminates have demonstrated improved ballistic VSO performance and improved back face deformation performance against high energy deformable projectiles such as bullet threats when compared to woven fabric systems for the same areal density. Disadvantages associated with the unidirectional laminate structure include reduced fragmentation threat resistance, increased stiffness and potentially reduced mechanical fatigue resistance when compared to woven structures generated with the same fiber.

Due to the aforementioned issue associated with its use in woven constructions, the unidirectional laminate was conventionally the preferred anti-ballistic structure for UHMWPE fiber. UHMWPE has found significant commercial success in soft armor systems when used in unidirectional laminate structures. These materials are commercially available under the trade names Spectra Shield® from Honeywell, or Dyneema® Unidirectional from DSM. These unidirectional laminate materials are generated using tacky adhesive matrix resins capable of overcoming the low surface friction and low surface energy of the UHMWPE fiber, resulting in mechanically stable anti-ballistic structures.

While the present disclosure has been described with reference to various implementations, it will be understood that these implementations are illustrative and that the scope of the disclosure is not limited to them. Many variations, modifications, additions, and improvements are possible. More generally, implementations in accordance with the present disclosure have been described in the context of particular examples. Functionality may be separated or combined in blocks differently in various implementations of the disclosure or described with different terminology. These and other variations, modifications, additions, and improvements may fall within the scope of the disclosure as defined in the claims that follow.

After reading the present disclosure, one of ordinary skill will appreciate that the various features described herein may be combined in various ways without departing from the scope of the present disclosure.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B, and C may be present in a single embodiment; for example, A and B, A and C, B and C, or A and B and C.

Systems, methods, and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A ballistic system, comprising:

a cover defining an opening and forming a pocket, a headrest hood operatively coupled to the cover and configured to be installed over a headrest of a vehicle seat;

an armor assembly installable in the cover; and a ballistic backer partially installable in the cover, the backer including a protruding portion that extends out of the cover;

wherein the cover comprises a front and a back, wherein the back contacts a back of the vehicle seat in response to the ballistic seat backer being installed in a vehicle.

2. The ballistic system of claim 1, wherein the cover is made of 1000 denier nylon.

3. The ballistic system of claim 1, wherein the cover includes a mole array of the front of the cover.

4. The ballistic system of claim 1, wherein the headrest hood is made of a 4 way stretch nylon material.

5. The ballistic system of claim 1, wherein the cover is sized such that it provides ballistic coverage for the headrest of the vehicle.

6. The ballistic system of claim 1, wherein the backer is a rigid backer.

7. The ballistic system of claim 1, wherein the protruding portion of the backer is sized to install in a rear pocket of a vehicle seat.

8. The ballistic system of claim 1, further comprising a handle operatively coupled to the backer.

9. The ballistic system of claim 1, wherein the armor system includes a plurality of unidirectional aramid or polyethylene ballistic laminate sheets.

10. The ballistic system of claim 1, wherein the armor system includes a one or more woven aramid fabric sheets.

11. A ballistic system, comprising:

a cover defining an opening and forming a pocket;

a headrest hood operatively coupled to the cover and configured to be installed over a headrest of a vehicle;

an armor assembly installable in the cover, wherein the cover and the armor system have nesting perimeter profiles; and a backer partially installable in the cover, the backer including a protruding portion that extends out of the cover.

12. The ballistic system of claim 1, wherein the cover and the backer have nesting perimeter profiles.

13. The ballistic system of claim 1, wherein the cover has a top curved portion.

* * * * *